US007365714B2

(12) United States Patent
Yoo

(10) Patent No.: US 7,365,714 B2
(45) Date of Patent: Apr. 29, 2008

(54) DATA DRIVING APPARATUS AND METHOD OF DRIVING ORGANIC ELECTRO LUMINESCENCE DISPLAY PANEL

(75) Inventor: Juhn Suk Yoo, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 910 days.

(21) Appl. No.: 10/698,400

(22) Filed: Nov. 3, 2003

(65) Prior Publication Data

US 2004/0090400 A1 May 13, 2004

(30) Foreign Application Priority Data

Nov. 5, 2002 (KR) ..... 10-2002-0068183

(51) Int. Cl.
*G09G 3/30* (2006.01)

(52) U.S. Cl. ..... 345/76

(58) Field of Classification Search ..... 345/76
See application file for complete search history.

(56) References Cited

U.S. PATENT DOCUMENTS 7,151,511 B2 * 12/2006 Koyama ..... 345/76
2002/0005825 A1 * 1/2002 Lee et al. ..... 345/76

FOREIGN PATENT DOCUMENTS

| | | | |
|---|---|---|---|
| CN | 1361510 | A | 7/2002 |
| EP | 1 164 565 | A1 | 12/2001 |
| KR | 10-2002-0056353 | A | 7/2002 |

* cited by examiner

*Primary Examiner*—Amare Mengistu
*Assistant Examiner*—Grant D. Sitta
(74) *Attorney, Agent, or Firm*—McKenna Long & Aldridge, LLP

(57) ABSTRACT

A data driving apparatus of an organic electro luminescence display (OELD) panel provides a current to the OELD panel, causing the OELD panel to display pictures. The data driving apparatus may include a data driver for applying data signals using a substantially uniform current; and a data signal controller circuit integrated with the OELD panel for charging and controlling the substantially uniform current in response to the data signals outputted from the data driver so as to apply the data signals to the organic electro luminescence display panel.

5 Claims, 16 Drawing Sheets

DATA DRIVING APPARATUS AND METHOD OF DRIVING ORGANIC ELECTRO LUMINESCENCE DISPLAY PANEL

This application claims the benefit of Korean Patent Application No. 2002-68183 filed on Nov. 5, 2002, which is hereby incorporated by reference for all purposes as if fully set forth herein.

BACKGROUND OF THE INVENTION

1. Field of the Invention

The present invention relates to a data driving apparatus for organic electro luminescence display (OELD) panels, and more particularly to a data driving apparatus and method for driving an OELD panel that that improves a picture quality of the panel and while reducing the number of data drive switching devices used.

2. Description of the Related Art

Until recently, cathode ray tubes (CRTs) have generally been used in display systems. However, use of newly developed flat panel displays such as liquid crystal displays (LCDs), field emission displays (FEDs), plasma display panels (PDPs), and electro-luminescence (EL) devices are becoming increasingly common due to their low weight, thin dimensions, and low power consumption.

PDPs, being thin, lightweight, and having large display areas, are structurally simple and relatively easy to manufacture. However, PDSs have relatively poor light emission characteristics causing the pictures they display to have a low brightness. Further, PDPs generally dissipate a large amount of power. Light emission characteristics of LCDs, on the other hand, are generally better than those of PDPs. However, LCDs having large display areas are difficult to fabricate LCDs because their manufacturing processes generally include those used in the semiconductor industry and are provided with a plurality of switching elements such as thin film transistors (TFTs). Accordingly, LCDs are generally used as display devices in notebook computers.

Depending on the type of material used as a light-emitting layer, EL devices are classifiable as inorganic EL devices or as organic EL devices. Generally, EL devices are self-luminous devices with excellent response speeds and light emission characteristics and are capable of displaying images at a high brightness and over wide ranges of viewing angles.

FIG. 1 illustrates a cross-sectional view of a related art organic electro-luminescence device.

Referring to FIG. 1, organic EL devices generally include a first electrode 14 made of a transparent, electrically conductive material, a hole injection layer 12 formed on the first electrode 14, a hole transport layer 10 formed on the hole injection layer 12, a light emission layer 8 formed on the hole transport layer 10, an electron transport layer 6 formed on the light emission layer 8, an electron injection layer 4 formed on the electron transport layer 6, and a second electrode 2, formed of a metallic material, is formed on the electron injection layer 4.

When a voltage is applied to the first and second electrodes 14 and 2, electrons generated at the second electrode 2 migrate toward the light emission layer 8 via the electron injection and transport layers 4 and 6, respectively, while holes generated at the first electrode 14 migrate toward the light emission layer 8 via the hole injection and transport layers 4 and 10, respectively. When the electrons recombine with the holes in the light emission layer 8, light is generated and emitted through the first electrode 14 to display pictures.

FIG. 2 illustrates a block diagram of a related art driving apparatus for driving an organic electro luminescence display panel.

Referring to FIG. 2, a related art driving apparatus is generally coupled to an OELD panel. The OELD panel includes an electro luminescence (EL) display panel 20 having pixel cells PE arranged at crossings of gate lines GL and data lines DL. The related art driving apparatus includes a scan driver 22 for driving the gate lines GL, a data driver 24 driving the data lines DL, and a controller 28 for controlling the driving of the scan and data drivers 22 and 24.

Gate signals applied from the gate lines GL enable pixel cells PE connected to the gate lines to generate light to a predetermined brightness according to a voltage associated with pixel signals applied from corresponding data lines DL.

The controller 28 simultaneously applies gate control signals GCS (i.e., start pulses and clock signals) to the scan driver 22 while applying data control signals and data signals to the data driver 24. In response to the gate control signals GCS applied from the controller 28, the scan driver 22 sequentially applies scan pulses SP to the gate lines GL. In response to the data control signals and data signals applied from the controller 28, the data driver 24 applies the data signals to the pixel cells PE via the data lines DL. Moreover, the data driver 24 applies the data signals to the data lines according to the application of the scan pulses SP to the gate lines GL by the scan driver 22 during each scan period.

FIG. 3 illustrates an equivalent circuit diagram of pixels within the organic electro luminescence display panel shown in FIG. 2.

Referring to FIG. 3, each of the pixel cells PE within the OELD panel 20 consist of an organic light emitting diode (OLED) connected to a cell drive voltage source VDD and a cell driver 26 for driving the OLED. The cell driver 26 is formed at crossings of each of the gate and data lines GL and DL and includes a first thin film transistor (TFT) T1 formed between the cell drive voltage source VDD and the OLED for driving the OLED; a second TFT T2 connected to the cell drive voltage source VDD to form a current mirror with the first TFT T1; a third TFT T3 connected between the second TFT T2, the data line DL, and the gate line GL, to respond to a signal applied from the gate line GL; a fourth TFT T4 connected between the gate terminals of the first TFT T1, the second TFT T2, the gate line GL, and the third TFT T3. Moreover, each pixel cell PE includes a storage capacitor Cst connected between the gate terminals of the first and second TFTs T1 and T2 and the cell drive voltage source VDD. The first to fourth TFTs T1 to T4 are generally provided as p-type MOS-FETs.

The third and fourth TFTs T3 and T4 each include source, drain, and gate terminals and may be turned on in response to a negative scan voltage applied from the gate lines GL, as shown in FIG. 4. When the third and fourth TFTs T3 and T4 are turned on (i.e., when the third and fourth TFTs T3 and T4 are maintained in an ON state), electrically conductive paths are created between the source and drain terminals third and fourth TFTs T3 and T4. When the voltage applied from the gate lines GL is less than a threshold voltage Vth of the third and fourth TFTs T3 and T4, the third and fourth TFTs T3 and T4 are turned off (i.e., third and fourth TFTs T3 and T4 are maintained in an OFF state) and the electrically conductive paths cease to exist. While the third and fourth TFTs T3 and T4 are maintained in the ON state, a data signal DATA applied from a corresponding one of the data lines DL is applied to the gate terminal of the first TFT T1 via the third and fourth TFTs T3 and T4. When the third and fourth TFTs T3 and T4 are maintained in the OFF state, a data signal DATA is not applied to the first TFT T1.

Accordingly, the first TFT T1 controls a current conducted between its source and drain terminals in accordance with the data signal DATA applied to its gate terminal to cause the OLED to emit light, wherein the brightness to which the light is emitted corresponds to the data signal DATA.

The second TFT T2 is provided as a current mirror of the first TFT T1 to uniformly control the current conducted from the first TFT T1 to the OLED.

The storage capacitor Cst stores a voltage equal to the voltage difference between the voltage associated with the data signal DATA and the cell drive voltage VDD. Accordingly, the capacitor Cst causes the voltage applied to the gate terminal of the first TFT T1 to be uniformly maintained during one frame period of the OLED while the current is uniformly applied to the OLED during the one frame period.

Upon driving the OELD panel 20 as shown in FIG. 4, a capacitance, having a magnitude dependent upon the structure of the OELD panel 20, in addition to a rising time of the data signal DATA applied to the data lines DL by the data driver 24, having an value dependent upon a line resistance, may increase. Such an increase in capacitance and rising time can distort the data signal DATA outputted by the data driver 24. As a result, the data signal DATA may not be sufficiently applied to a pixel cell PE during an enable period of the gate signal applied from the gate line GL and the quality at which pictures are displayable by the OELD panel 20 may be deteriorated. To prevent deterioration in the display quality, data signal controller circuits such as those shown in FIG. 5 can be electrically coupled to data lines DL of the related art OELD panel 20.

Referring to FIG. 5, related art data signal controller circuits are generally provided as a self-contained circuit set, separately formed from the related art OELD panel 20, and externally connectable to the data lines DL of the OELD panel 20. Moreover, the related art data signal controller circuits include a first data signal controller circuit 28A and a second data signal controller circuit 28B substantially identical to the first data signal controller circuit 28A. Lastly, the first and second data signal controller circuits 28A and 28B are connected in parallel between the data driver 24 and the data lines DL.

Accordingly, each of the first and second data signal controller circuits 28A and 28B include a first TFT S1 connected between the data driver 24 and a first node n1 arranged between the data line DL and a ground voltage source GND; a second TFT S2 forming a current mirror with the first TFT T1; a third TFT S3 connected between a second node n2, the first node n1, and the ground voltage source GND; a capacitor Cd connected between the second node n2 and the ground voltage source GND; and a fourth TFT S4 connected between the data line DL and the first node n1. Moreover, the first to fourth TFTs S1 to S4 are generally provided as n-type MOS-FETs.

First and second enable signals A and B, respectively, are alternately applied to gate terminals of the fourth TFTs S4 within the first and second data signal controller circuits 28A and 28B, allowing the first and second data signal controller circuits 28A and 28B to alternately sample a current and to alternately drive corresponding ones of the pixel cells PE. For example, the first data signal controller circuit 28A drives the pixel cells PE when the current is sampled by the second data signal controller circuit 28B.

Applied to the first TFTs S1 of the first and second data signal controller circuits 28A and 28B, first and second enable control signals A1 and B1, respectively, allow data signals DATA to be applied from the data driver 24 to the first node n1, and subsequently to the data line DL. As the first and second enable control signals A1 and B1 are applied to respective ones of the first TFTs S1, the first and second enable control signals A1 and B1 are simultaneously applied to the second TFTs S2 of the first and second data signal controller circuits 28A and 28B, allowing the second TFTs S2 to apply the data signal DATA to the second node n2.

The capacitor Cd is charged with a voltage associated with the data signal DATA applied to the second node n2 and applies the charged voltage to the gate terminal of the third TFT S3. As a result, the third TFT S3 can control the current between its source terminal and drain terminal in accordance with the data voltage charged in the capacitor Cd and transmit the controlled current to the pixel cells PE via the data line DL.

The fourth TFTs S4 of the first and second data signal controller circuits 28A and 28B are turned on in the presence of the applied first and second enable signals A and B. When turned on, the fourth TFTs S4 transmit the current outputted by corresponding ones of the third TFTs S3 to the data line DL.

FIG. 6 illustrates a waveform diagram of drive signals of the data signal controller circuit shown in FIG. 5.

Referring to FIG. 6, the first and second enable signals A and B are alternately applied to the fourth TFTs S4 of the first and second data signal controller circuits 28A and 28B. Accordingly, the first and second data signal controller circuits 28A and 28B are alternately driven over consecutive frames. First enable control signals A1, A2 and A3 applied to the first data signal controller circuit 28A cause a group of red, green, and blue data signals, respectively, to be inputted to corresponding ones of the data lines DL1, DL2, and DL3, respectively.

FIG. 7 illustrates an enlarged view of an exemplary portion of the related art data signal controller circuit shown in FIG. 5. FIG. 8A illustrates a first state of the exemplary portion of the related art data signal controller circuit shown in FIG. 7 while FIG. 8B illustrates a second state of the exemplary portion of the related art data signal controller circuit shown in FIG. 7.

Referring to FIGS. 7, 8A, and 8B, the related art data signal controller circuits include a plurality of shift registers 32 for shifting enable signals used to turn the first and second TFTs S1 and S2 on. Accordingly, data signal controller circuits have first and second states as shown below in TABLE 1.

TABLE 1

| | First State | Second State |
|---|---|---|
| S1 | ON | OFF |
| S2 | ON | OFF |
| S3 | OFF | ON |
| State | Current is Stored | Current is Applied to Pixel |

Referring to FIG. 8A, the first and second TFTs S1 and S2 are maintained in an ON state, the fourth TFT T4 is maintained in an OFF state, and the related art data signal controller circuit is maintained in the first state. Accordingly, a current having a magnitude associated with the voltage of a data signal DATA applied from the data driver 24 is transmitted to the third TFT S3. As a result, the third TFT S3 acts as a diode while the capacitor Cd becomes charged with a voltage corresponding to the current transmitted to the third TFT S3.

Referring to FIG. 8B, the first and second TFTs S1 and S2 are turned off (i.e., maintained in their OFF states), the fourth TFT T4 is maintained in the ON state, and the related art data signal controller circuit is maintained in the second state. Accordingly, a current having a magnitude associated with the voltage stored by the capacitor Cd is transmitted by the third TFT S3 to the pixel cells PE via the data line DL.

Use of the related art data signal controller circuit described above, however, is disadvantageous because the first and second data signal controller circuits 28A and 28B are arranged in parallel. Accordingly, many switching devices must be used, thus complicating the operation and fabrication of the device.

SUMMARY OF THE INVENTION

Accordingly, the present invention is directed to a data driving apparatus and a method of driving an organic electro luminescence display panel that substantially obviates one or more of the problems due to limitations and disadvantages of the related art.

An advantage of the present invention provides a data driving apparatus and a method for driving an organic electro luminescence display panel that requires a reduced amount of switching devices.

Another advantage of the present invention provides a data driving apparatus and a method for driving an organic electro luminescence display panel that improves picture display quality of the panel by sufficiently applying data signals to corresponding pixels during an enable period of corresponding gate signals.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a data driving apparatus of an organic electro luminescence display (OELD) panel according may, for example, provide a current to the OELD panel, causing the OELD panel to display pictures, wherein the data driving apparatus may, for example, include a data driver for outputting data signals formed using a substantially uniform current; and a data signal controller circuit integrated with the OELD panel for charging the substantially uniform current corresponding to the outputted data signals outputted from the data driver and for applying the data signals to the OELD panel on the basis of the substantially uniform current.

In one aspect of the present invention, the data driving apparatus may further include a scan driver for applying scan signals to the OELD panel and a timing controller for controlling the scan driver, the data driver, and the data signal controller circuit.

In another aspect of the present invention, the OELD panel may, for example, include gate lines; data lines crossing the gate lines; pixel cells formed at crossings of the gate and data lines, wherein each pixel cell includes an organic electro luminescence (OEL) cell and a cell driver and wherein the cell driving device includes: a first switching device formed between a cell drive voltage source and the OLED for driving the OLED; a second switching device connected to the cell drive voltage source to form a current mirror with the first switching device; a third switching device connected to the second switching device, a gate electrode line, and a data line for responding to a data signal outputted by the data driver; a fourth switching device connected to the gate terminals of the second and third switching devices, a data line, and the third switching device; and a storage capacitor connected between the gate terminals of the first and second switching devices and the cell drive voltage source.

In still another aspect of the present invention, the data signal controller circuit may, for example, include constant current supply switching devices having gate terminals connected to a cell drive voltage source for applying the constant current to the data lines.

In yet another aspect of the present invention, the data signal controller circuit may include a first data signal controller circuit for storing a voltage corresponding to the data signals outputted from the data driver during application of a first scan signal; a second data signal controller circuit for storing a voltage corresponding to a data signal outputted from the first data signal controller circuit and for applying the stored voltage to the data lines between the application of the first scan signal and application of a second scan signal; a first switch connected between the data driver and the first data signal controller circuit for providing a current path from the data driver; and a second switch connected between the first data signal controller circuit and the second data signal controller circuit for providing a current path from the first data signal controller circuit.

In still a further aspect of the present invention, the data signal controller circuit may further include a drive signal supplier for driving the first and second data signal controller circuit.

In yet a further aspect of the present invention, the driving signal supplier may include a shift register for driving the first data signal controller circuit and the first switch during application of the scan signal; and a line pass controller for driving the second data signal controller circuit and the second switch between application of the first scan signal and application of the second scan signal.

In still a further aspect of the present invention, the first data signal controller circuit may, for example, include a fifth switching device connected between the cell drive voltage source and the second switch; a first capacitor connected between the gate terminal of the fifth switching device and the cell drive voltage source; and a third switch connected between the gate terminal of the fifth switching device and the second switch, wherein the third switch is controllable by the shift register.

In yet a further aspect of the present invention, the second data signal controller circuit may, for example, include a sixth switching device connected between the second switch and a ground voltage source; a second capacitor connected between the gate terminal of the sixth switching device and the ground voltage source; and a fourth switch connected between the gate terminal of the sixth switching device and the second switch, wherein the fourth switch is controllable by the line pass controller.

In still a further aspect of the present invention, the first switch is controllable by the shift register and the second switch is controllable by the line pass controller.

In yet another aspect of the present invention, each of the switching devices may be provided as a p-type or a n-type metal oxide semiconductor field effect transistor (MOSFET).

According to the principles of the present invention, a method of driving an organic electro luminescence display (OELD) panel having pixel cells arranged at crossings of gate lines and data lines may, for example, include outputting a first data signal from a data driver, wherein the first data signal is formed from a substantially uniform current; charging a first data signal controller circuit with a second data signal corresponding to the substantially uniform current in response to the outputted first data signal, wherein the first data signal controller circuit is controllable by a first drive signal during application of a first scan signal; charging a second data signal controller circuit with a third data signal corresponding to the substantially uniform current in response to the second data signal, wherein the second data signal controller circuit is controllable by a second drive signal between application of the first scan signal and application of a second scan signal; and applying the substantially uniform current to the data lines of the OELD panel in response to the third data signal during application of the second scan signal.

In one aspect of the present invention, charging the second data signal in the first data signal controller circuit may include forming a current path from the data driver in response to the first drive signal; inputting the first data signal from the data driver through the current path; and charging the second data signal having the substantially uniform current in accordance with the inputted first data signal.

In another aspect of the present invention, charging the third data signal in the second data signal controller circuit may, for example, include forming a current path from the first data signal controller circuit in response to the second drive signal; inputting the second data signal in accordance with a voltage charged from the first data signal controller circuit; and charging the third data signal having the substantially uniform current in accordance with the inputted second data signal.

In still another aspect of the present invention, the method of driving may further include inputting the third data signal during application of the second scan signal; charging a storage capacitor in the OELD panel in accordance with the inputted third data signal and simultaneously controlling a current path width of a switching device connected to an electro luminescence cell within the OELD panel; and causing the electro luminescence cell to emit light in accordance with a voltage difference between a cell drive voltage source and a ground voltage source and in accordance with the current path width.

In yet another aspect of the present invention, a current characteristic of the first and second data signals may be different from a current characteristic of the third data signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 9:
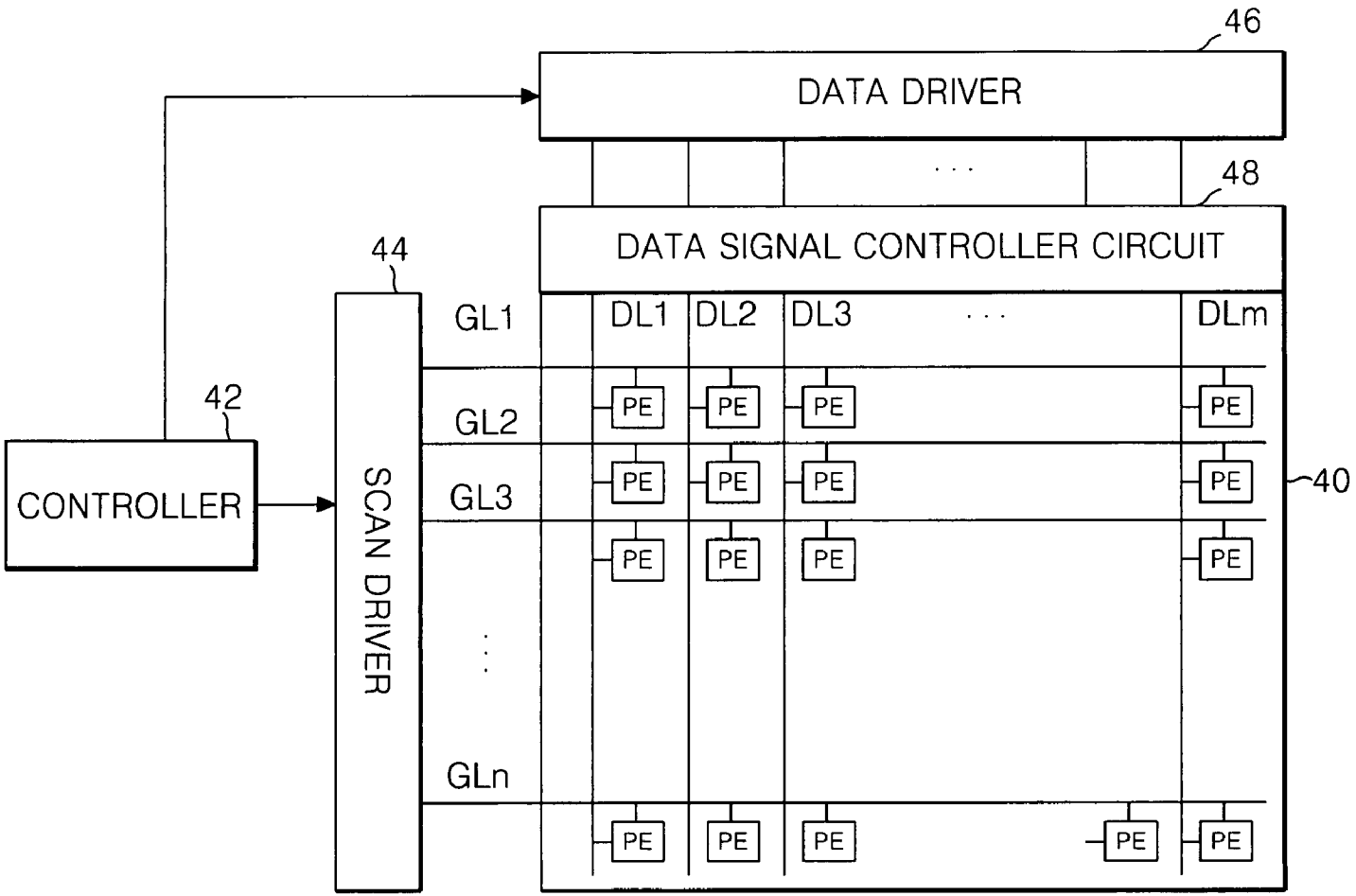
FIG. 9 illustrates a diagram of a driving apparatus for driving an organic electro luminescence display panel in accordance with the principles of the present invention.
Figure 10:
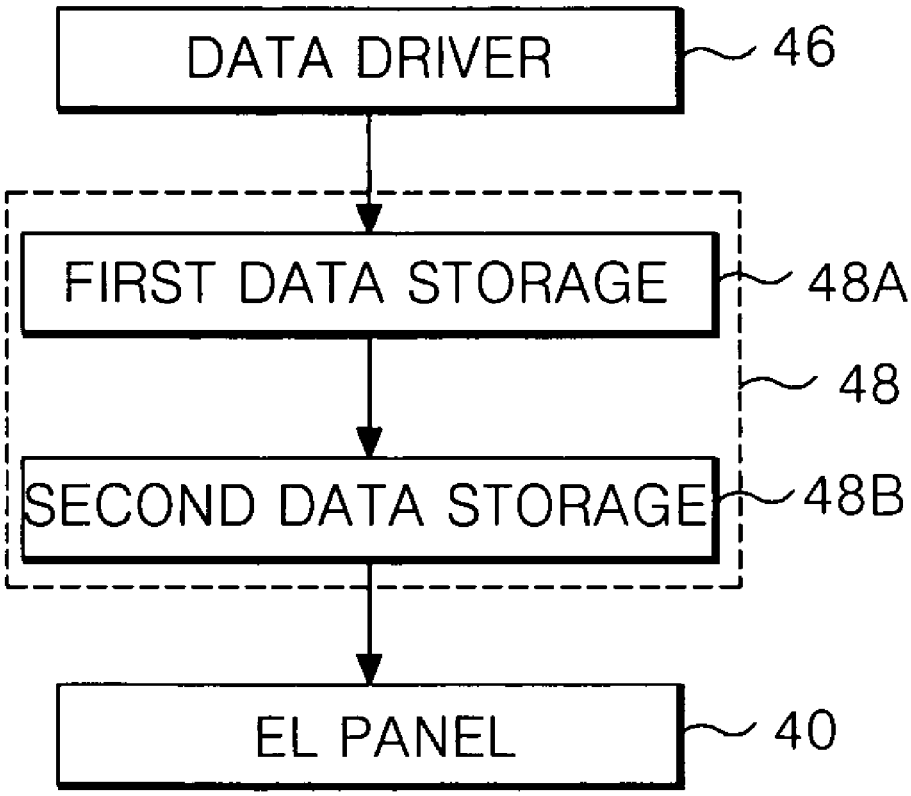
FIG. 10 schematically illustrates the driving apparatus including the data signal controller circuit shown in FIG. 9.

FIG. 9 illustrates a diagram of a driving apparatus for driving an organic electro luminescence display panel in accordance with the principles of the present invention. FIG. 10 schematically illustrates the driving apparatus including the data signal controller circuit shown in FIG. 9.

Referring to FIGS. 9 and 10, the driving apparatus for driving an organic electro luminescence display (OELD) panel in accordance with the principles of the present invention may, for example, be used to drive an OELD panel 40 having a plurality of pixel cells PE each arranged crossings of a plurality of gate lines GL and a plurality of data lines DL. According to the principles of the present invention, the driving apparatus may, for example, include a scan driver 44 for driving the gate lines GL of the OELD panel 40, a data driver 46 for driving the data lines DL of the OELD panel 40, a data signal controller circuit 48 arranged between the data driver 46 and the OELD panel 40 for controlling a current applied to the data lines DL of the OELD panel 40, and a controller 42 for controlling the scan driver 44 and the data driver 46.

Gate signals applied from the gate lines GL may enable pixel cells PE connected to the gate lines to generate light. Light may be generated by the pixel cells PE to a predetermined brightness according to a voltage associated with a pixel signal outputted from a corresponding data line DL.

The controller 42 may simultaneously apply gate control signals GCS (i.e., start pulses and clock signals) to the scan driver 44 while applying data control signals and data signals to the data driver 46. According to the principles of the present invention, the controller 42 may apply control signals that control the data signal controller circuit 48. In response to the gate control signals GCS applied from the controller 42, the scan driver 44 sequentially applies scan pulses SP to the gate lines GL. In response to the data control signals and data signals applied from the controller 42, data signals outputted by the data driver 46 may be applied to the pixel cells PE via the data lines DL. Moreover, the data driver 46 may output the data signals in accordance with the application of the scan pulses SP to the gate lines GL by the scan driver 44 during each scan period.

Figure 1:
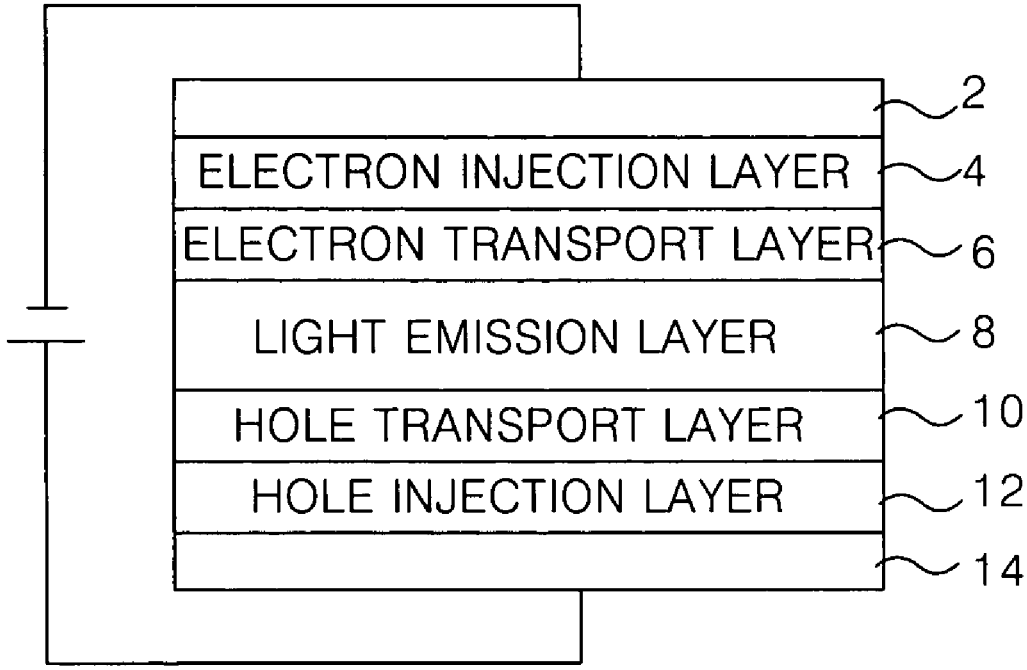
FIG. 1 RELATED ART
FIG. 1 illustrates a cross-sectional view of a related art organic electro-luminescence device.
Figure 2:
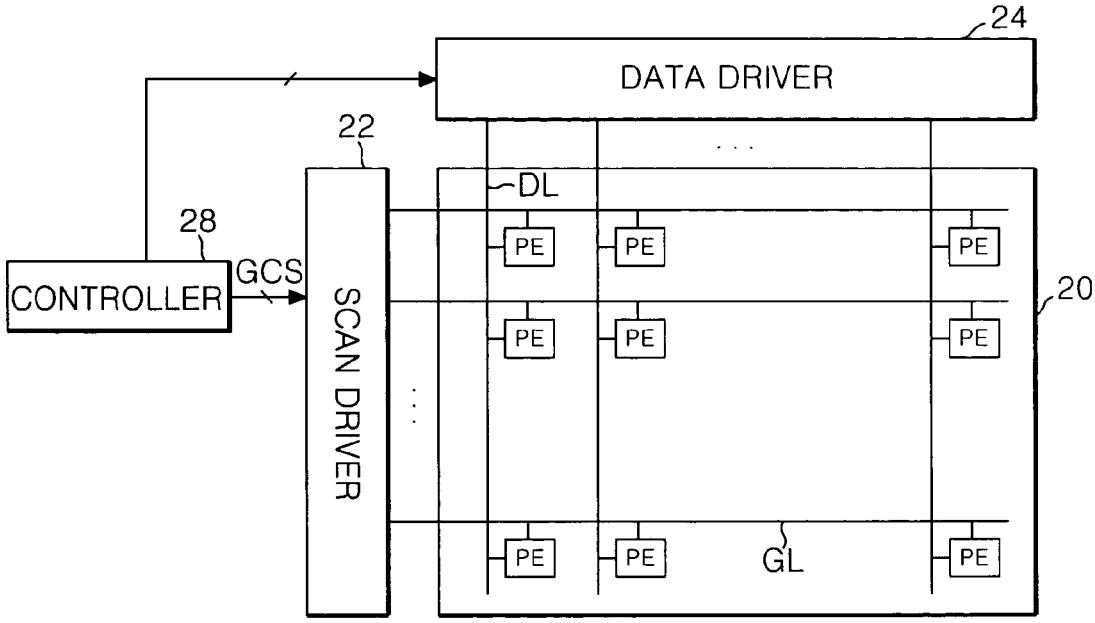
FIG. 2 RELATED ART
FIG. 2 illustrates a block diagram of a related art driving apparatus for driving an organic electro luminescence display panel.
Figure 3:
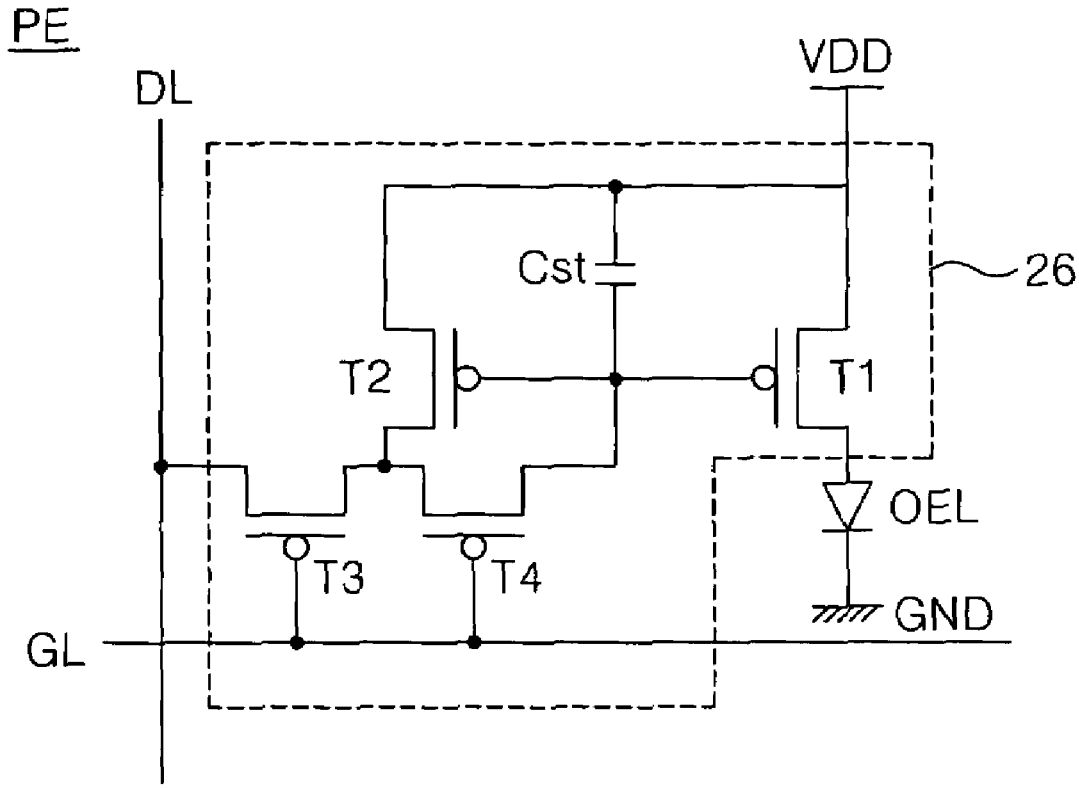
FIG. 3 RELATED ART
FIG. 3 illustrates an equivalent circuit diagram of pixels within the organic electro luminescence display panel shown in FIG. 2.
Figure 4:
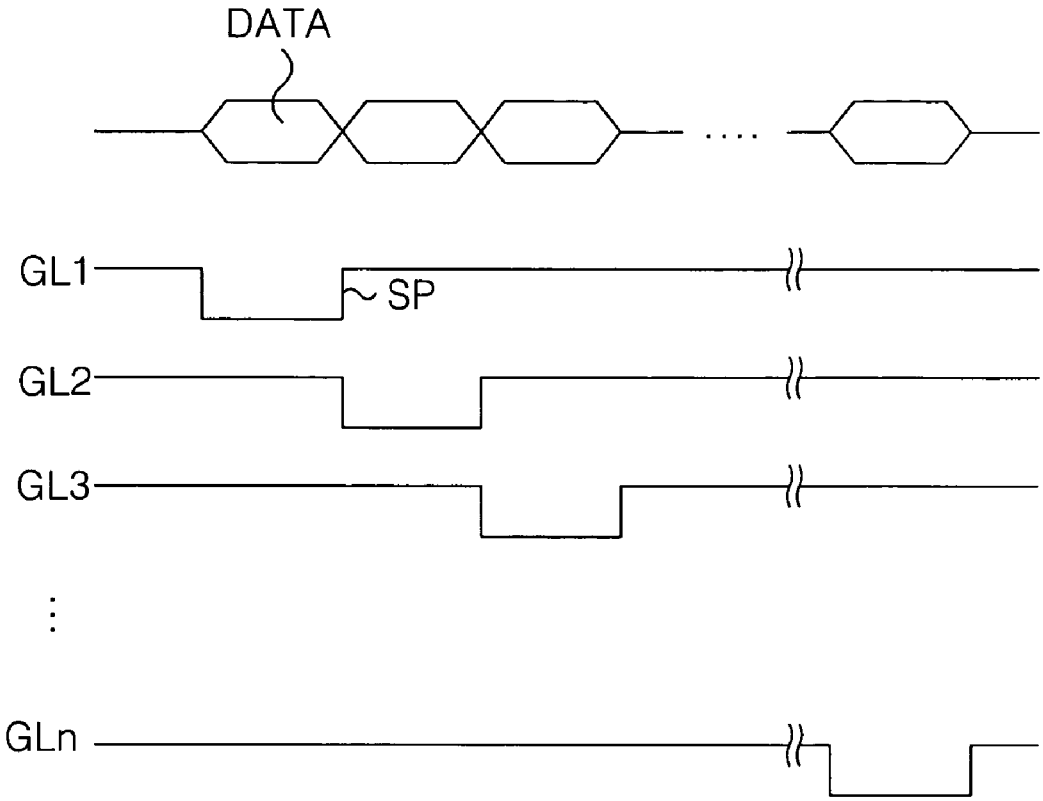
FIG. 4 RELATED ART
FIG. 4 illustrates waveforms of signals applied to gate lines and data line shown in FIGS. 2 and 3.
Figure 5:
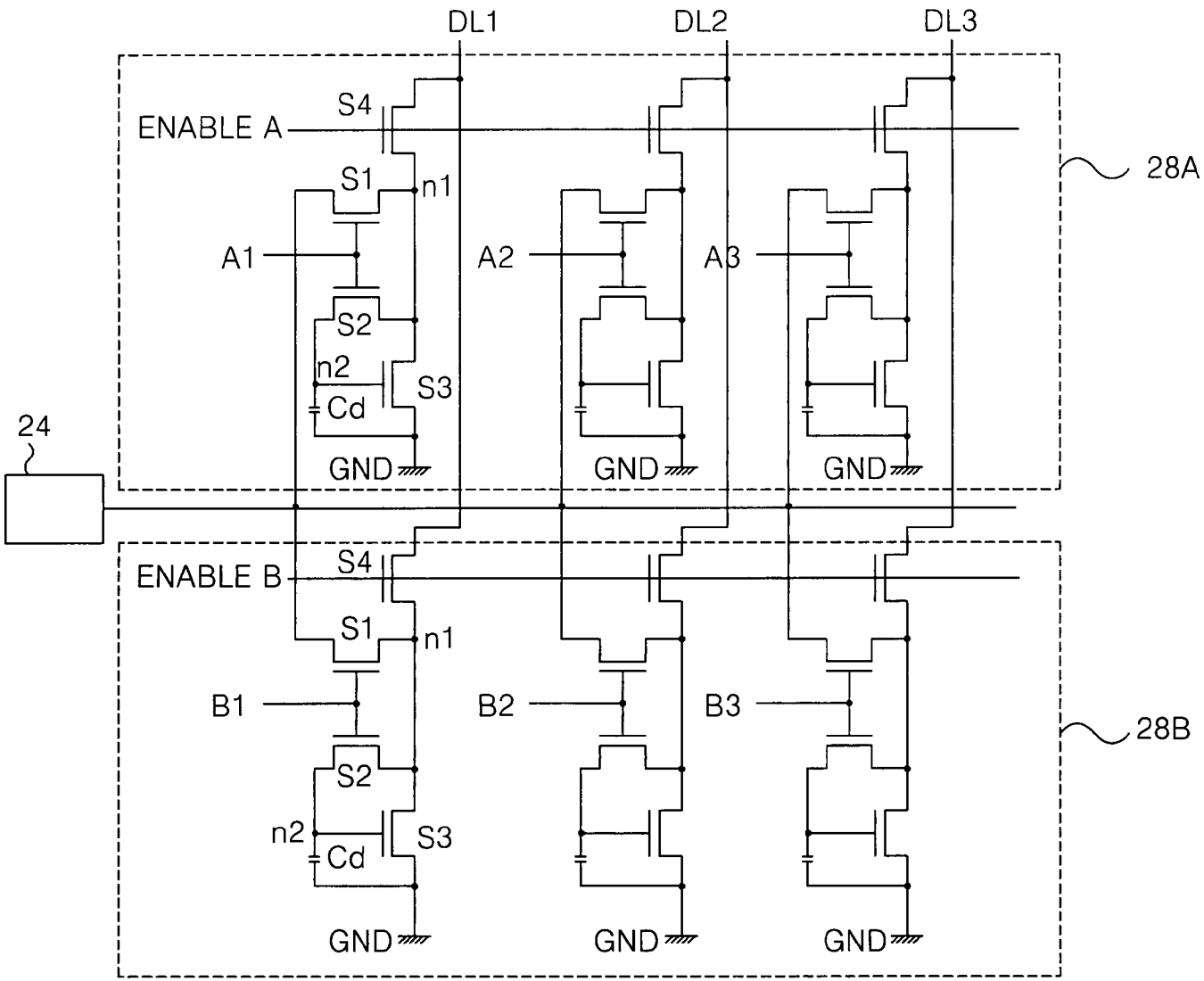
FIG. 5 RELATED ART
FIG. 5 illustrates a related art data signal controller circuit incorporated within the related art organic electro luminescence display panel shown in FIG. 2.
Figure 6:
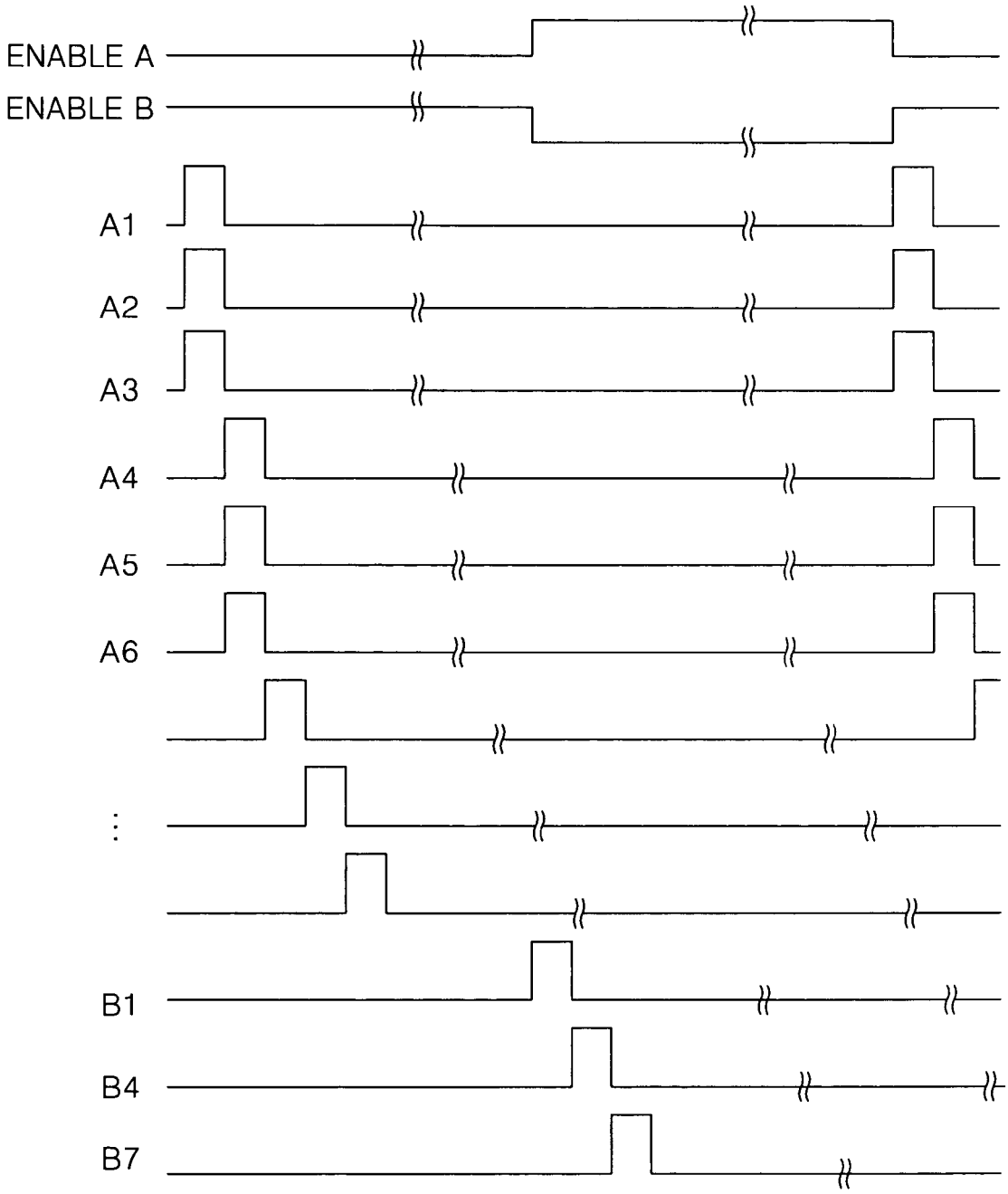
FIG.6 RELATED ART
FIG. 6 illustrates waveforms of drive signals applied to the data signal controller circuit shown in FIG. 5.
Figure 7:
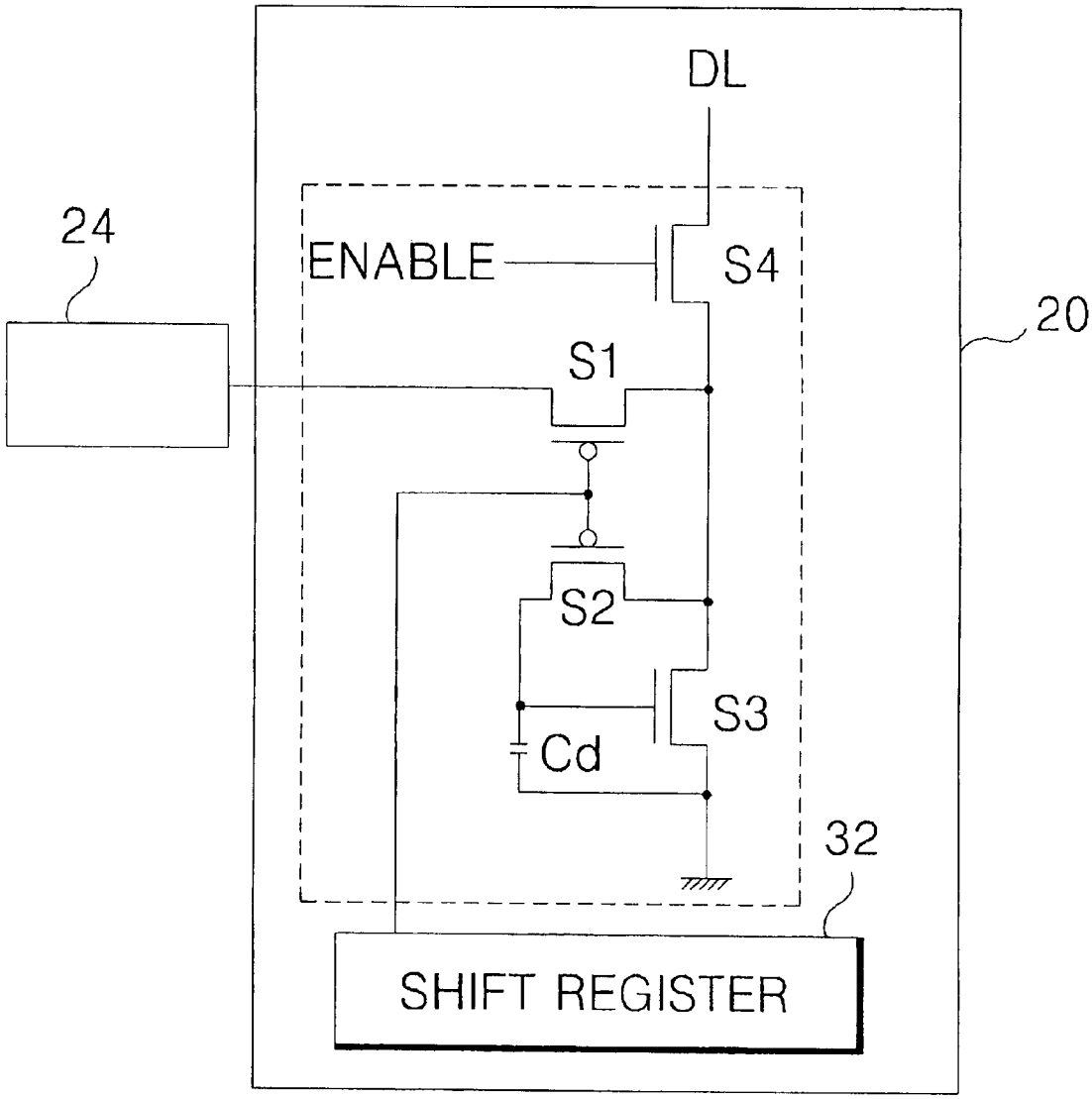
FIG.7 RELATED ART
FIG. 7 illustrates an enlarged view of an exemplary portion of the related art data signal controller circuit shown in FIG. 5.
Figure 8A:
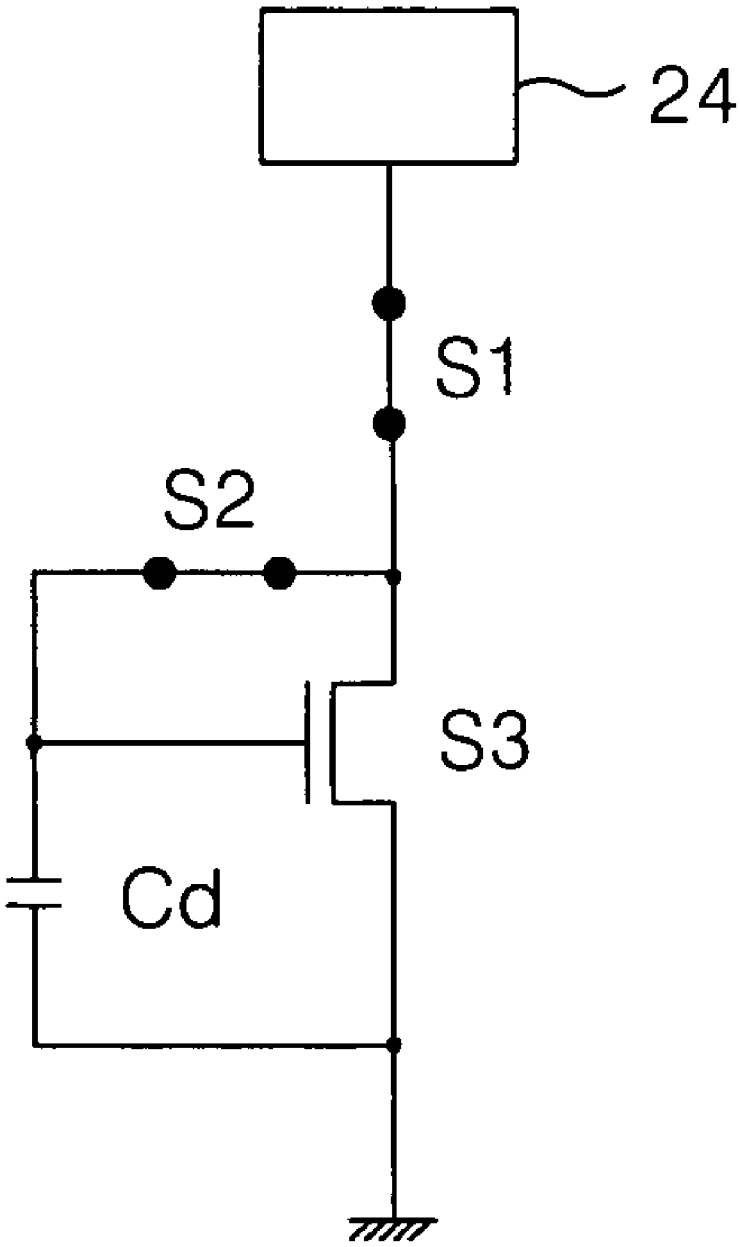
FIG. 8A RELATED ART
FIG. 8A illustrates a first state of the exemplary portion of the related art data signal controller circuit shown in FIG. 7.
Figure 8B:
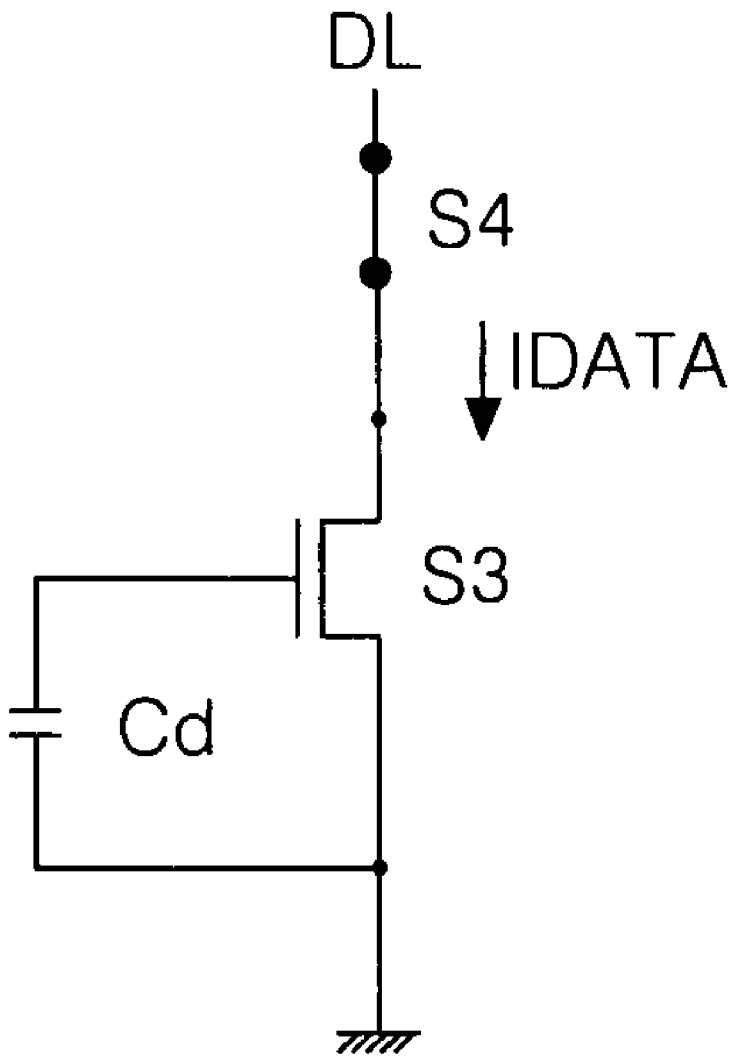
FIG.8B RELATED ART
FIG. 8B illustrates a second state of the exemplary portion of the related art data signal controller circuit shown in FIG. 7.

The data signal controller circuit 48 may store and control data signals outputted by the data driver 46 and apply the data signals to corresponding pixel cells PE during enable periods of gate signals. In one aspect of the present invention, the data signal controller circuit 48 may include polycrystalline silicon (poly-Si). In another aspect of the present invention, the data signal controller circuit 48 may be fabricated (e.g., formed) directly on a substrate (e.g., a glass substrate) of the OELD panel 40 using, for example, complementary metal-oxide semiconductor (CMOS) techniques (e.g., low temperature polysilicon (LTPS), sequential lateral solidification (SLS), etc.). In still another aspect of the present invention, the data signal controller circuit 48 may be mounted directly on the substrate of the OELD panel 40 using, for example, chip on glass (COG) techniques. It will be appreciated by those of ordinary skill in the art that, by providing the data signal controller circuit 48 by either of the aforementioned CMOS or COG techniques, the area of the OELD panel 40 may be significantly reduced compared to related art panels such as those illustrated in FIG. 2. In yet another aspect of the present invention, the data signal controller circuit 48 may be attached to a side portion of the OELD panel 40 using, for example, tape carrier package (TCP) techniques.

FIG. 10 schematically illustrates the driving apparatus including the data signal controller circuit shown in FIG. 9.

Referring to FIG. 10, the data signal controller circuit 48 may include a first data signal controller circuit 48A and a second data signal controller circuit 48B. In one aspect of the present invention, the data signal controller circuit 48 may store a current corresponding to data signals outputted by the data driver 46. In another aspect of the present invention, the data signal controller circuit 48 may transmit the stored current and the data signal, outputted by the data driver 46, to the pixel cells PE of the OELD panel 40 via the data lines DL.

Figure 14A:
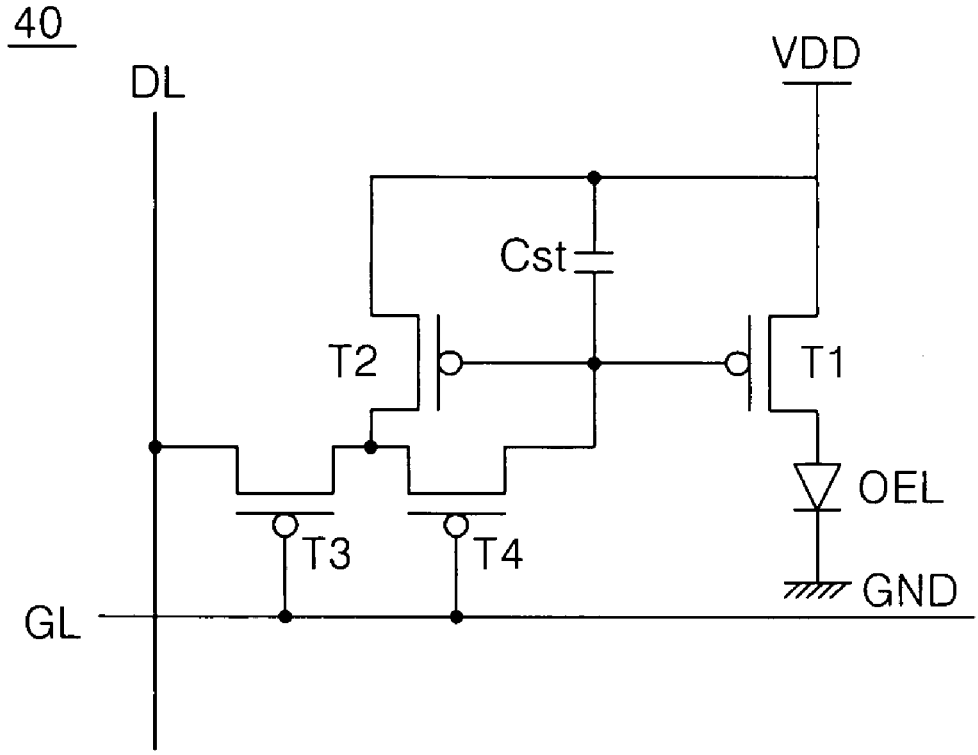
FIGS. 14A and 14B illustrate equivalent circuit diagrams of pixels within the organic electro luminescence display panel shown in FIG. 9.
Figure 14B:
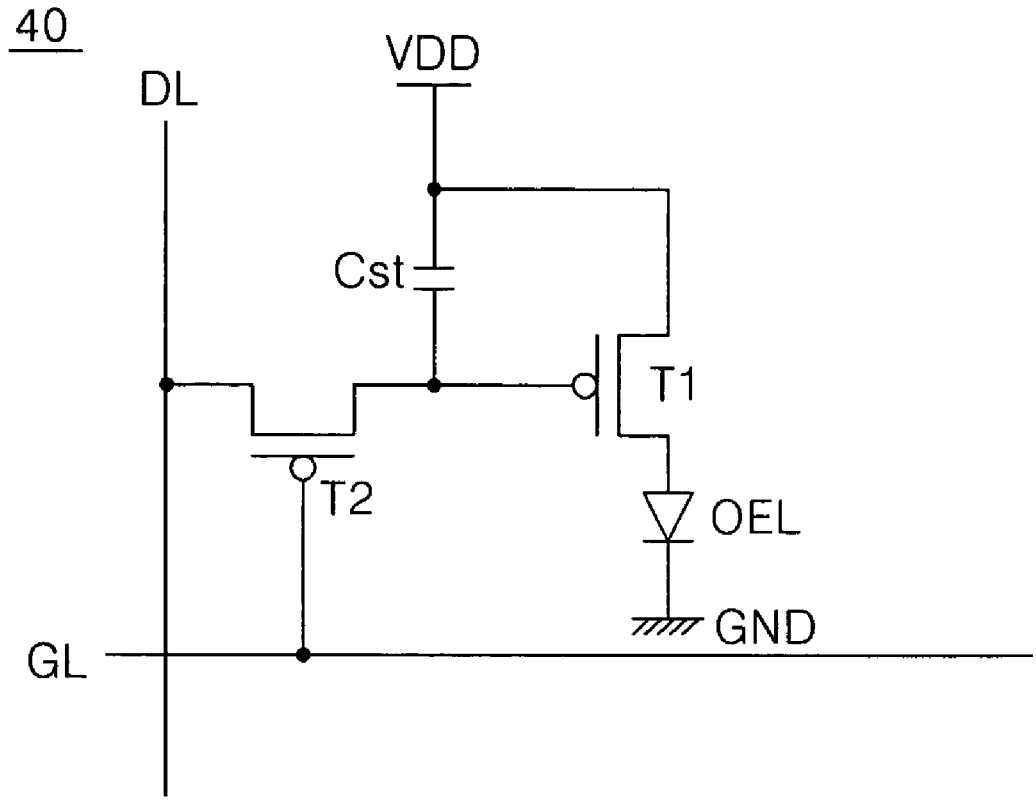

FIGS. 14A and 14B illustrate equivalent circuit diagrams of pixels within the organic electro luminescence display panel shown in FIG. 9.

Referring to FIG. 14A, each of the pixel cells PE within the OELD panel 40 may include an organic electro luminescence (OEL) cell connected to a cell drive voltage source VDD and a cell driver for driving the OLED. The cell driver may be formed at crossings of each of the gate and data lines GL and DL and may include a first thin film transistor (TFT) T1 formed between the cell drive voltage source VDD and the OLED for driving the OLED; a second TFT T2 connected to the cell drive voltage source VDD to form a current mirror with the first TFT T1; a third switch (e.g., TFT) T3 connected between the second TFT T2, the data line DL, and the gate line GL, to respond to a signal applied from the gate line GL; a fourth switch (e.g., TFT) T4 connected between the gate terminals of the first TFT T1, the second TFT T2, the gate line GL, and the third TFT T3. Moreover, each pixel cell PE may include a storage capacitor Cst connected between the gate terminals of the first and second TFTs T1 and T2 and the cell drive voltage source VDD. The first to fourth TFTs T1 to T4 may be provided as p-type MOS-FETs.

The third and fourth TFTs T3 and T4 may each include source, drain, and gate terminals and may be turned on in response to a negative scan voltage applied from the gate lines GL, as shown in FIG. 14. When the third and fourth TFTs T3 and T4 are turned on, (i.e., when the third and fourth TFTs T3 and T4 are maintained in an ON state), electrically conductive paths may be created between the source and drain terminals third and fourth TFTs T3 and T4. When the voltage applied from the gate lines GL is less than a threshold voltage Vth of the third and fourth TFTs T3 and T4, the third and fourth TFTs T3 and T4 may be turned off (i.e., third and fourth TFTs T3 and T4 are maintained in an OFF state) and the electrically conductive paths cease to exist. While the third and fourth TFTs T3 and T4 are maintained in the ON state, a data signal DATA applied from a corresponding one of the data lines DL may be applied to the gate terminal of the first TFT T1 via the third and fourth TFTs T3 and T4. When the third and fourth TFTs T3 and T4 are maintained in the OFF state, data signal DATA may not applied to the first TFT T1.

Accordingly, the first TFT T1 may control a current conducted between its source and drain terminals in accordance with the data signal DATA applied to its gate terminal to cause the OLED to emit light, wherein the brightness to which the light is emitted corresponds to the data signal DATA.

The second TFT T2 may be provided as a current mirror of the first TFT T1 to uniformly control the current conducted from the first TFT T1 to the OLED.

The capacitor Cst may store a voltage equal to the voltage difference between the voltage associated with the data signal DATA and the cell drive voltage VDD. Accordingly, the storage capacitor Cst may cause the voltage applied to the gate terminal of the first TFT T1 to be uniformly maintained during one frame period of the OLED while the current is uniformly applied to the OLED during the one frame period.

As described above, with reference to FIG. 14A, the cell driver is provided as a 4T-type (current addressing) cell driver. In accordance with the principles of the present invention, however, the aforementioned second TFT T2 and the fourth switch T4 within the current addressing cell driver may be omitted, thereby providing the cell driver as the 2T-type (voltage addressing) cell driver shown in FIG. 14B.

Referring to FIG. 14B, the first thin film transistor (TFT) T1 may be formed between the cell drive voltage source VDD and the OLED for driving the OLED. However, the aforementioned second and fourth TFTs T2 and T4 shown in the current addressing cell driver may be omitted to provide the voltage addressing cell driver. Accordingly, the voltage addressing cell driver includes a second switch (e.g., TFT) T2 connected between the first thin film transistor (TFT) T1, the data line DL, and the gate line GL, to respond to a signal applied from the gate line GL. While the second TFT T2 in the voltage addressing cell driver is maintained in the ON state, a data signal DATA applied from a corresponding one of the data lines DL may be applied to the gate terminal of the first TFT T1 via the second TFT T2.

Accordingly, the first TFT T1 may control a current conducted between its source and drain terminals in accordance with the data signal DATA applied to its gate terminal to cause the OLED to emit light, wherein the brightness to which the light is emitted corresponds to the data signal DATA.

Figure 11:
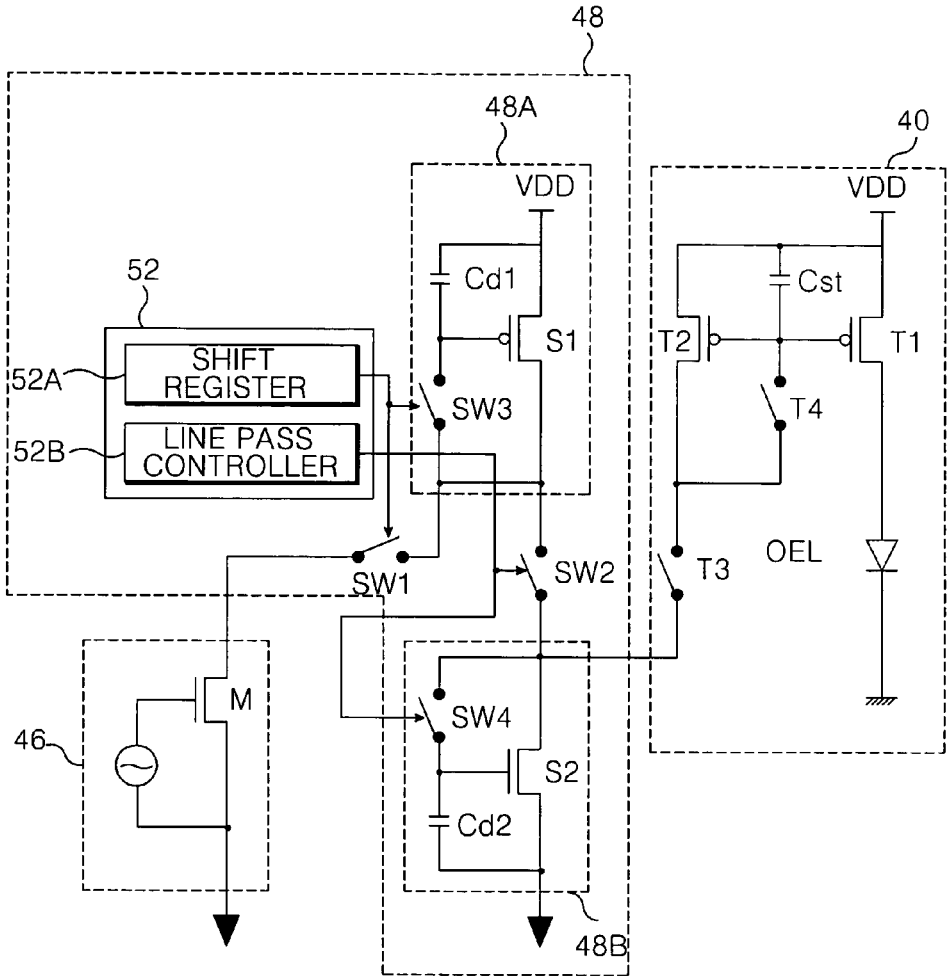
FIG. 11 illustrates the a circuit layout of the driving apparatus shown in FIG. 10, in accordance with the principles of a first aspect of the present invention.

FIG. 11 illustrates a circuit layout of the driving apparatus shown in FIG. 10, in accordance with the principles of a first aspect of the present invention.

Referring to FIG. 11, the data driving apparatus for driving an OELD panel 40 in accordance with the principles of a first aspect of the present invention may, for example, include a data driver 46 and a data signal controller circuit 48 sequentially connected to an OELD panel 40. In one aspect of the present invention, the data signal controller circuit 48 may, for example, include a first data signal controller circuit 48A, a second data signal controller circuit 48B, and a drive signal supplier 52 for applying a drive signal to the first and second data signal controller circuits 48A and 48B, to drive the first and second data signal controller circuits 48A and 48B.

In one aspect of the present invention, the data driver 46 may include a constant current source TFT (M) having a gate terminal connected to a cell drive voltage source VDD. Accordingly, the constant current source may apply a substantially uniform current to the data lines DL, and thus to the pixel cells PE connected to the data lines DL. In another aspect of the present invention, the data driver 46 may include a reference TFT (not shown) connected to the cell drive voltage source VDD and a constant current source TFT (M), connected to the cell drive voltage source VDD, and parallel with the reference TFT, to form a current mirror circuit. Accordingly, the constant current source may apply a substantially uniform current to the data lines DL, and thus to the pixel cells PE connected to the data lines DL. In still another aspect of the present invention, the data driver 46 a switching device (not shown) may be connected between each constant current source TFT M and each data line DL. Accordingly, the switching device may control a time during which the substantially uniform current is applied from the constant current supply TFT M. In one aspect of the present invention, an inputted data signal may control the switching device, enabling the substantially uniform current to be applied for a predetermined amount of time. Accordingly, the inputted data signal may control a pulse width of a current signal. In one aspect of the present invention, the reference TFT (not shown) and the constant current source TFT M may be provided as n-type MOS-FETs.

According to the principles of the present invention, the drive signal supplier 52 may be controlled by the controller 42 and include a shift register 52A, for controlling the application of the drive signal to the first data signal controller circuit 48A, and a line pass controller 52B, for controlling the application of the drive signal to the second data signal controller circuit 48B. In one aspect of the present invention, the drive signal supplier 52 may include a first switch SW1 for providing a current path between the data driver 46 and the first data signal controller circuit 48A. In another aspect of the present invention, the drive signal supplier 52 may include a second switch SW2 for providing a current path between the first data signal controller circuit 48A and the second data signal controller circuit 48B. The shift register 52A may apply a turn-on signal when a scan pulse SP is applied to the pre-stage gate line GL (i.e., when the pre-stage gate line GL is driven). Further, the line pass controller 52B may apply a turn-on signal, causing a current stored at the first storage means 48A to be transmitted to, and stored within, the second data signal controller circuit 48B.

According to the principles of the present invention, the first data signal controller circuit 48A may, for example, include a first TFT S1 connected between the cell drive voltage source VDD and the second data signal controller circuit 48B, a first capacitor Cd1 connected between the gate terminal of the first TFT S1 and the cell drive voltage source VDD, and a third switch SW3 connected between the gate terminal of the first TFT S1 and the second data signal controller circuit 48B. In one aspect of the present invention, the first TFT S1 may be provided as a p-type MOS-FET.

According to the principles of the present invention, the second data signal controller circuit 48B may, for example, include a second TFT S2 connected between the first data signal controller circuit 48A and a ground voltage source GND, a second capacitor Cd2 connected between the gate terminal of the second TFT S2 and the ground voltage source GND, and a fourth switch SW4 connected between the gate terminal of the second TFT S2 and the first data signal controller circuit 48A. In one aspect of the present invention, the second TFT S2 may be provided as an n-type MOS-FET.

According to the principles of the present invention, the aforementioned constant current source TFT M (e.g., an n-type MOS-FET) within the data driver 46 may be provided as a current sink-type switching device capable of controlling a current of the data signals outputted by the data driver 46. Via the first TFT S1 (e.g., a p-type MOS-FET), the first data signal controller circuit 48A may sequentially control and store the current associated with the data signals outputted by the data driver 46. Via the second TFT S2 (e.g., an n-type MOS-FET), the second data signal controller circuit 48B may sequentially control and store the current stored by the first data signal controller circuit 48A. Subsequently, via the first to fourth TFTs T1 to T4 (e.g., p-type MOS-FETs) of the cell driver 126, the brightness of pictures displayable by OLEDs within the OELD panel 40 may be controlled.

Figure 12:
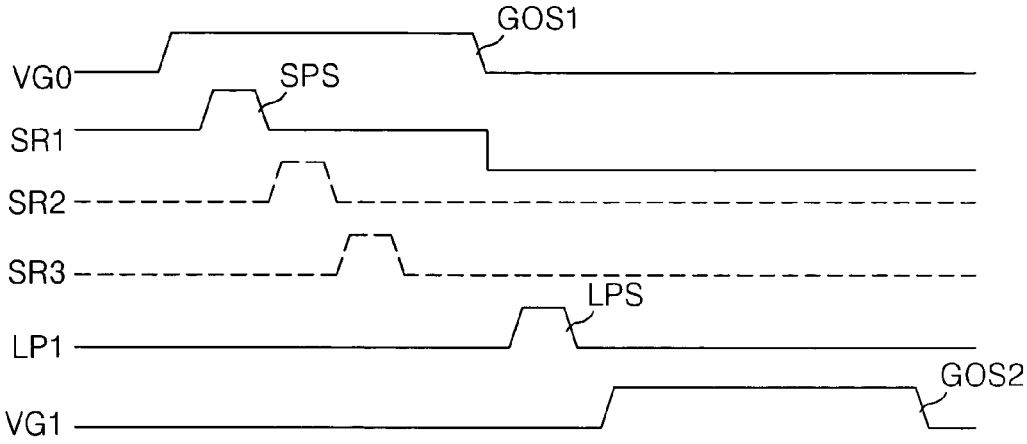
FIG. 12 illustrates waveforms of the driving apparatus shown in FIG. 11.

FIG. 12 illustrates waveforms of the driving apparatus shown in FIG. 11.

Referring to FIGS. 11 and 12, when a scan pulse SP is applied to a pre-stage gate line (e.g., when a first gate-on signal GOS1 is applied to gate line GLn-1), the shift register 52A may apply sampling signals SPS, thereby rendering the first and third switches SW1 and SW3 electrically conductive. As shown in FIG. 12, SR1, SR2, and SR3 correspond, for example, to sampling signals SPS specific to red, green, and blue color data. Accordingly, data signals outputted by the data driver 46 may be transmitted by the first and third switches SW1 and SW3 to the first TFT S1 of the first data signal controller circuit 48A. As a result, the first capacitor Cd1 may be charged with a voltage corresponding to the current of the data signals transmitted to the first TFT S1.

When the pre-stage gate line (e.g., GLn-1) is not driven (e.g., when one horizontal period is complete), the line pass controller 52B may apply a turn-on signal LPS, thereby rendering the second and fourth switches SW2 and SW4 electrically conductive. Accordingly, data signals outputted by the first data signal controller circuit 48A may be transmitted by the second and fourth switches SW2 and SW4 to the second TFT S2 of the second data signal controller circuit 48B. As a result, the second capacitor Cd2 may be charged with a voltage corresponding to the current of the data signals transmitted to the second TFT S2.

According to the principles of the present invention, the turn-on signal LPS may be applied from the line pass controller 52B between the application of the first gate-on signal GOS1, used in driving the pre-stage gate line GLn-1, and the application of a succeeding scan signal (e.g., second gate-on signal GOS2), for driving a gate line GLn, succeeding the pre-stage gate line GLn-1.

When the second scan pulse SP is applied to a gate line succeeding the pre-stage gate line (e.g., when a second gate-on signal GOS2 is applied to the gate line GLn, succeeding the pre-stage gate line GLn-1), the third and fourth TFTs T3 and T4 of the cell drivers within pixel cells PB of the EL display panel 40, connected to the gate line GLn, are maintained in the aforementioned ON state. When the third and fourth TFTs T3 and T4 are maintained in their ON states, the current stored within the second data signal controller circuit 48B (e.g., the current corresponding to the data signal outputted by the data driver 46) may be charged to corresponding ones of the storage capacitors Cst within pixel cells PE of the EL display panel 40. Subsequently, the voltage charged in the storage capacitors Cst may be applied to the gate terminal of the first TFT T1 in the pixel cells PE and the amount of current conducted between the source and drain terminals of the first TFT T1, applied from the cell drive voltage source VDD, may thereby be controlled in accordance with the outputted data signals. As a result, the OLED may emit light in accordance with the amount of current applied from the cell drive voltage source VDD and conducted between the source and drain terminals of the first TFT T1. Accordingly, current may be applied from the data signal controller circuit 48 to the pixel cells PE within the OELD panel 40 such that a luminosity value displayed by the pixel cells PE across the OELD panel 40 varies, at most, by about 30%. In one aspect of the present invention, current may be applied from the data signal controller circuit 48 to the pixel cells PE within the OELD panel 40 such that a luminosity value displayed by the pixel cells PE across the OBLD panel 40 varies by about 5%

Figure 13:
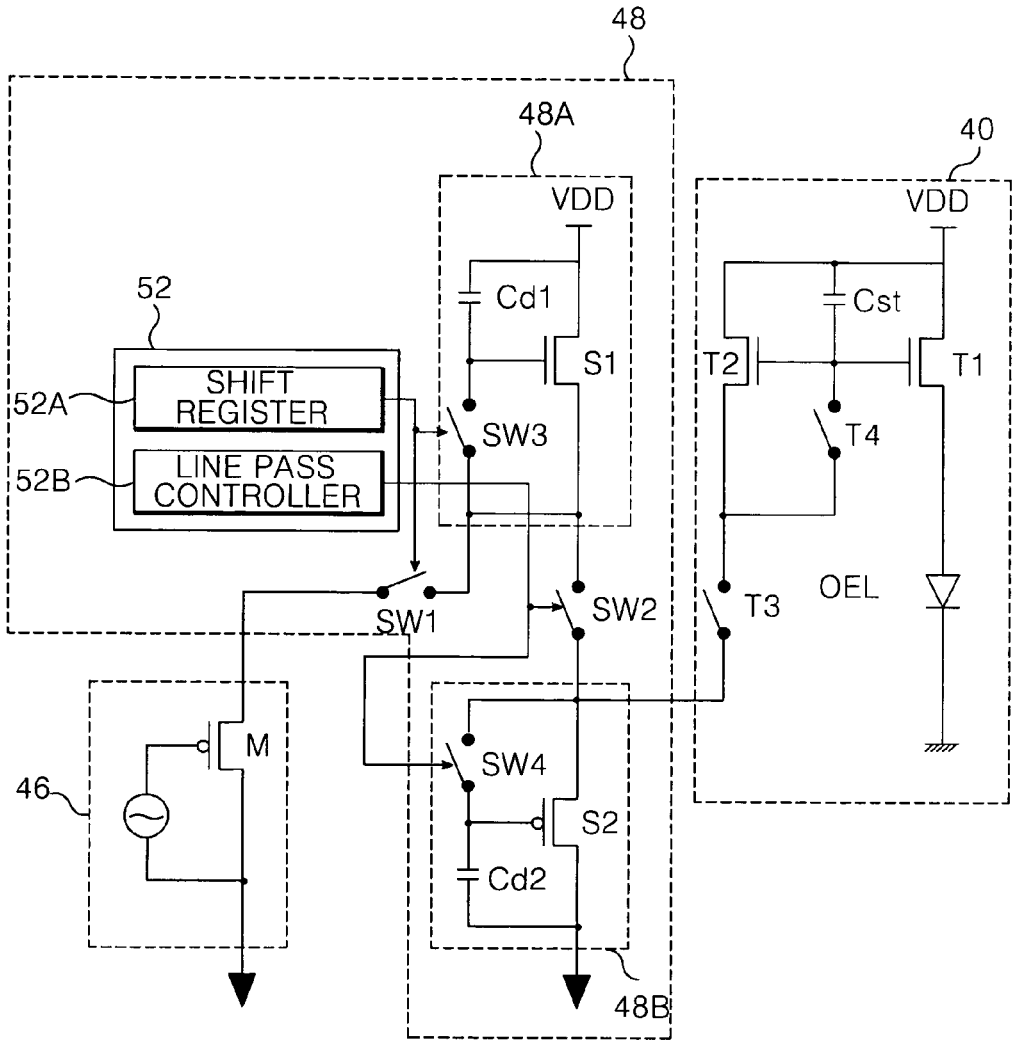
FIG. 13 illustrates the a circuit layout of the driving apparatus shown in FIG. 10, in accordance with the principles of a second aspect of the present invention.

FIG. 13 illustrates the a circuit layout of the driving apparatus shown in FIG. 10, in accordance with the principles of a second aspect of the present invention.

Referring to FIG. 13, the data driving apparatus for driving an OELD panel 40 in accordance with the principles of a second aspect of the present invention may, for example, include a reference TFT (not shown) and constant current source TFT M arranged in the data driver 46 but provided as n-type MOS-FETs. The first TFT S1 of the first storage means 48A may be provided as a p-type MOS-FET, the second TFT S2 of the second storage means 48B may be provided as an n-type MOS-FET, and the first to fourth TFTs T1 to T4 within the cell drivers 126 of the OELD panel 40 may be provided as n-type TFTs.

As described above, the data driving apparatus and method of driving the OELD panel according to the principles of the present invention may, for example, include a data signal controller circuit arranged on the OELD display panel and connected to the data driver. Accordingly, drive signals outputted by the data driver may be transmitted to the OELD panel. Further, the data signal controller circuit may be integrated within the OELD panel, reducing the number of drive ICs required to be formed within the data driver.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A data driving apparatus for driving an organic electro luminescence display (OELD) panel, comprising:

a data driver that outputs data signals formed using a substantially uniform current;

a data signal controller circuit connected to the data driver for charging a substantially uniform current corresponding to the outputted data signals and for applying the outputted charged current corresponding to the outputted data signals, wherein light is emittable by the OELD panel in the presence of the substantially uniform current; and a plurality of data lines coupled between the data signal controller circuit and the OELD panel, wherein the data signal controller circuit includes;

a plurality of constant current supply switching devices having gate terminals connected to a cell drive voltage source for applying the substantially uniform current to the data lines;

a first data signal controller circuit for storing a voltage corresponding to the data signals outputted by the data driver during application of a first scan signal;

a second data signal controller circuit for storing a voltage corresponding to a data signal outputted from the first data signal controller circuit and for applying the stored voltage to the data lines between application of the first scan signal and a subsequent application of a second scan signal;

a first switch connected between the data driver and the first data signal controller circuit for providing a current path between the data driver and the first data signal controller circuit;

a second switch connected between the first data signal controller circuit and the second data signal controller circuit for providing a current path between the first data signal controller circuit and the second data signal controller circuit;

a drive signal supplier including a shift register for driving the first data signal controller circuit and the first switch during application of the first scan signal and a line pass controller for driving the second data signal controller circuit and the second switch between application of the first scan signal and application of the second scan signal for driving the first and second data signal controller circuit, wherein the first data signal controller circuit includes: a fifth switching device connected between the cell drive voltage source and the second switch; a first capacitor connected between a gate terminal of the fifth switching device and the cell drive voltage source; and a third switch connected between the gate terminal of the fifth switching device and the second switch, wherein the third switch is controllable by the shift register, and the second data signal controller circuit includes:

a sixth switching device connected between the second switch and a ground voltage source; a second capacitor connected between a gate terminal of the sixth switching device and the ground voltage source; and a fourth switch connected between the gate terminal of the sixth switching device and the second switch, wherein the fourth switch in controllable by the line pass controller.

2. The data driving apparatus according to claim 1, wherein the first switch is controllable by the shift register.

3. The data driving apparatus according to claim 1, wherein the second switch is controllable by the line pass controller.

4. The data driving apparatus according to claim 1, wherein at least one of the switching devices is provided as a p-type metal oxide semiconductor field effect transistor (MOSFET).

5. The data driving apparatus according to claim 1, wherein at least one of the switching devices is provided as an n-type metal oxide semiconductor field effect transistor (MOSFET).

* * * * *